US007131643B1

(12) United States Patent
Sankey, II

(10) Patent No.: US 7,131,643 B1
(45) Date of Patent: Nov. 7, 2006

(54) CLAMPING SYSTEM

(76) Inventor: George W. Sankey, II, 79 Sankey La., Osceola Mills, PA (US) 16666

( * ) Notice: Subject to any disclaimer, the term of this patent is extended or adjusted under 35 U.S.C. 154(b) by 106 days.

(21) Appl. No.: 10/904,136

(22) Filed: Oct. 26, 2004

Related U.S. Application Data

(60) Provisional application No. 60/481,563, filed on Oct. 27, 2003.

(51) Int. Cl.
*B25B 1/02* (2006.01)

(52) U.S. Cl. ..... 269/203; 269/166

(58) Field of Classification Search ..... 269/203, 269/166–170, 143, 147–148
See application file for complete search history.

(56) References Cited

U.S. PATENT DOCUMENTS 319,517 A * 6/1885 Sheldon ..... 269/215
359,942 A * 3/1887 Shaw ..... 269/146
404,368 A * 5/1889 Sterns ..... 269/147
775,659 A * 11/1904 Jorgensen ..... 269/146
881,530 A * 3/1908 Barker ..... 269/230
1,452,164 A * 4/1923 Margelis ..... 269/203
6,554,264 B1 * 4/2003 Alford ..... 269/147

* cited by examiner

*Primary Examiner*—Lee D. Wilson
(74) *Attorney, Agent, or Firm*—John J. Elnitski, Jr.

(57) ABSTRACT

A clamping system including a fixed end and an adjustable end. Both ends having a support and a lock ring pivotally attached to the support. The lock ring has a bottom, top and two sides which together form a receiving area to receive lumber. The fixed end including a fixed face with a clamping surface extending from the support. The adjustable end has an adjustable face with a clamping surface slidably mounted to the support. The adjustable face being moveable along the support towards the fixed end to allow clamping between the clamping surface of the fixed end and the clamping surface of the adjustable end. The lock ring and support including teeth to engage the lumber.

19 Claims, 7 Drawing Sheets

CLAMPING SYSTEM

BACKGROUND

The present invention generally relates to clamps. More specifically, the present invention relates to clamp systems similar to bar clamps.

Bar clamps include a bar, a fixed end and an adjustable end. The bar is typical a rectangular piece of metal or a round pipe. The fixed end is attached to one end of the bar in a secure manner. The fixed end is usually secured using a fastener such as screw or pin to prevent movement of the fixed end along the bar. The fixed end includes a fixed clamping face. The adjustable end is attached to the bar near the other end of the bar in a secure manner. The adjustable end is usually secured using a fastener such as screw or pin to prevent movement of the adjustable end along the bar. The adjustable end is usually fixed to the bar in an area close to the clamping size of an object to be clamped. The adjustable end includes a main body with an adjustable face which moves along the main body. The adjustable face is movable towards the fixed face to clamp the object in place. The typical method of moving the adjustable face is the used of a threaded rod which moves the adjustable face in relation to the main body. The bar of the bar clamp is larger than the object to be clamped. This allows the object to fit between the fixed end and the adjustable end that are on the bar. Bar clamps are typically used in wood working projects like furniture manufacturing, where large clamps are required. An even larger clamping application is the clamping of walls of a building together. The use of the current type of bar clamp for clamping building walls is not realistic due to the size and weight of the metal bar required.

It is an object of the present invention to provide a clamping system for very large applications with the attributes of a bar clamp.

SUMMARY OF THE INVENTION

A clamping system including a fixed end and an adjustable end. Both ends having a support and a lock ring pivotally attached to the support. The lock ring has a bottom, top and two sides which together form a receiving area to receive lumber. The fixed end including a fixed face with a clamping surface extending from the support. The adjustable end has an adjustable face with a clamping surface slidably mounted to the support. The adjustable face being moveable along the support towards the fixed end to allow clamping between the clamping surface of the fixed end and the clamping surface of the adjustable end. The lock ring and support including teeth to engage the lumber.

DETAILED DESCRIPTION

Figure 3:
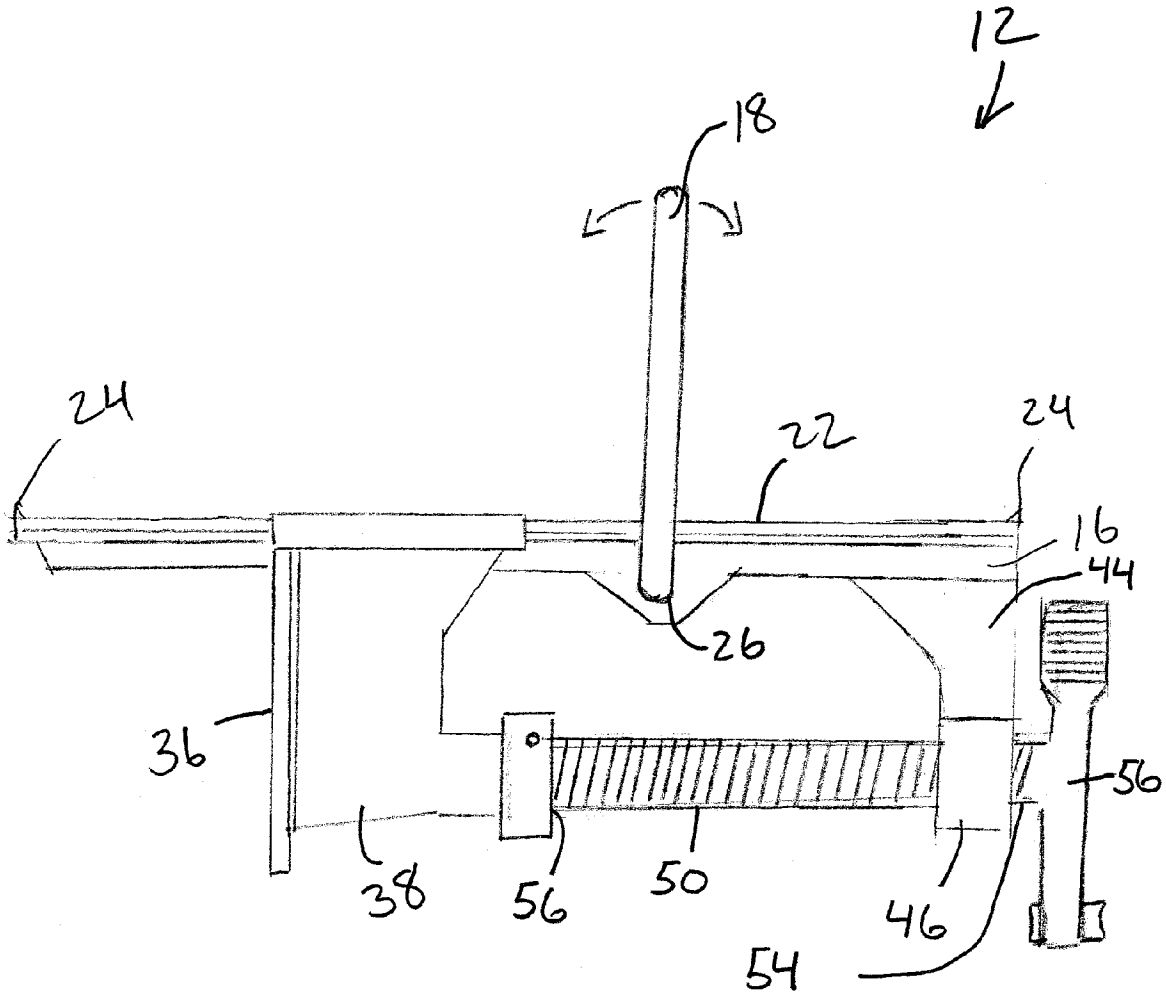
FIG. 3 is a side view of an adjustable end according to the present invention.
Figure 4:
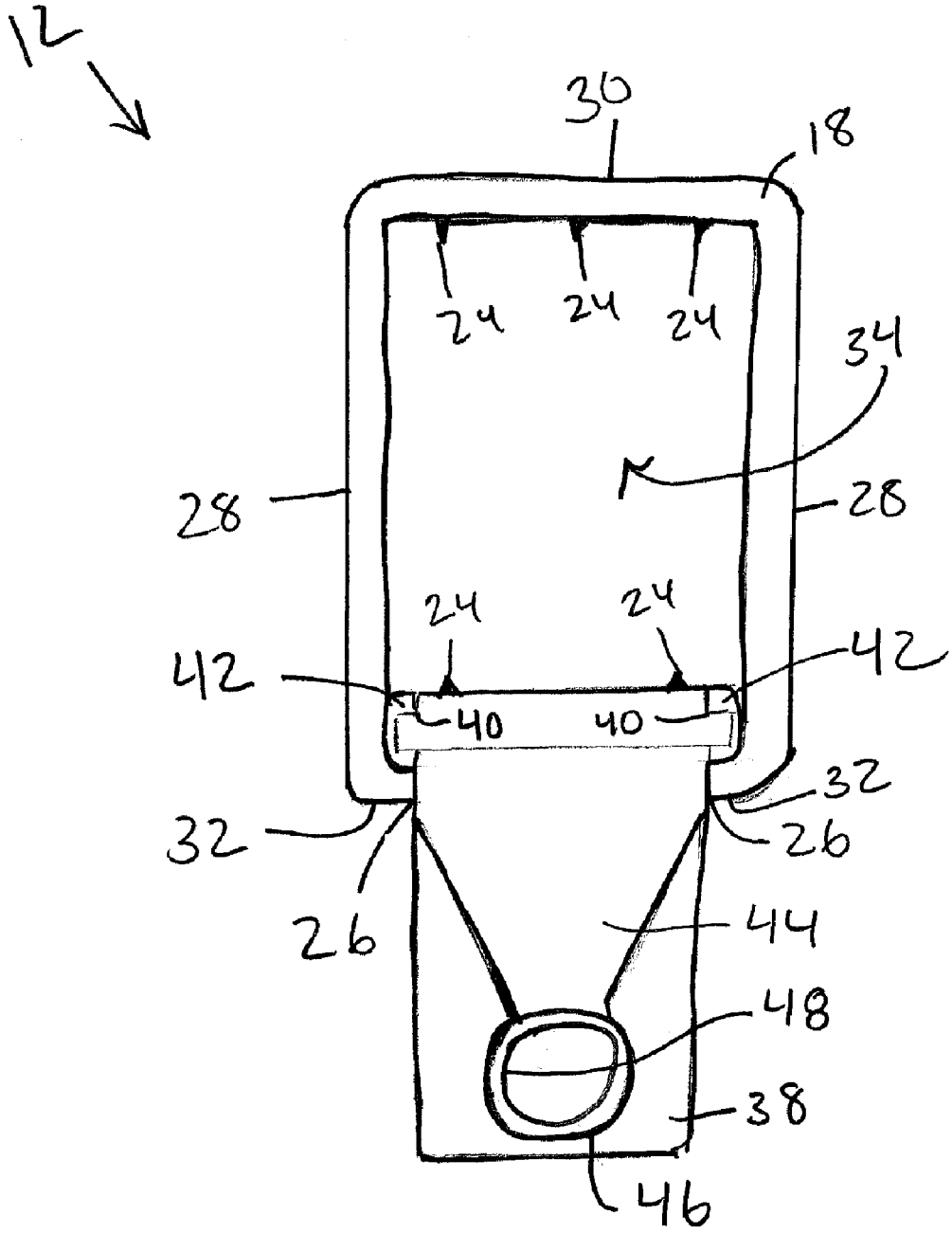
FIG. 4 is a front view of an adjustable end according to the present invention.
Figure 5:
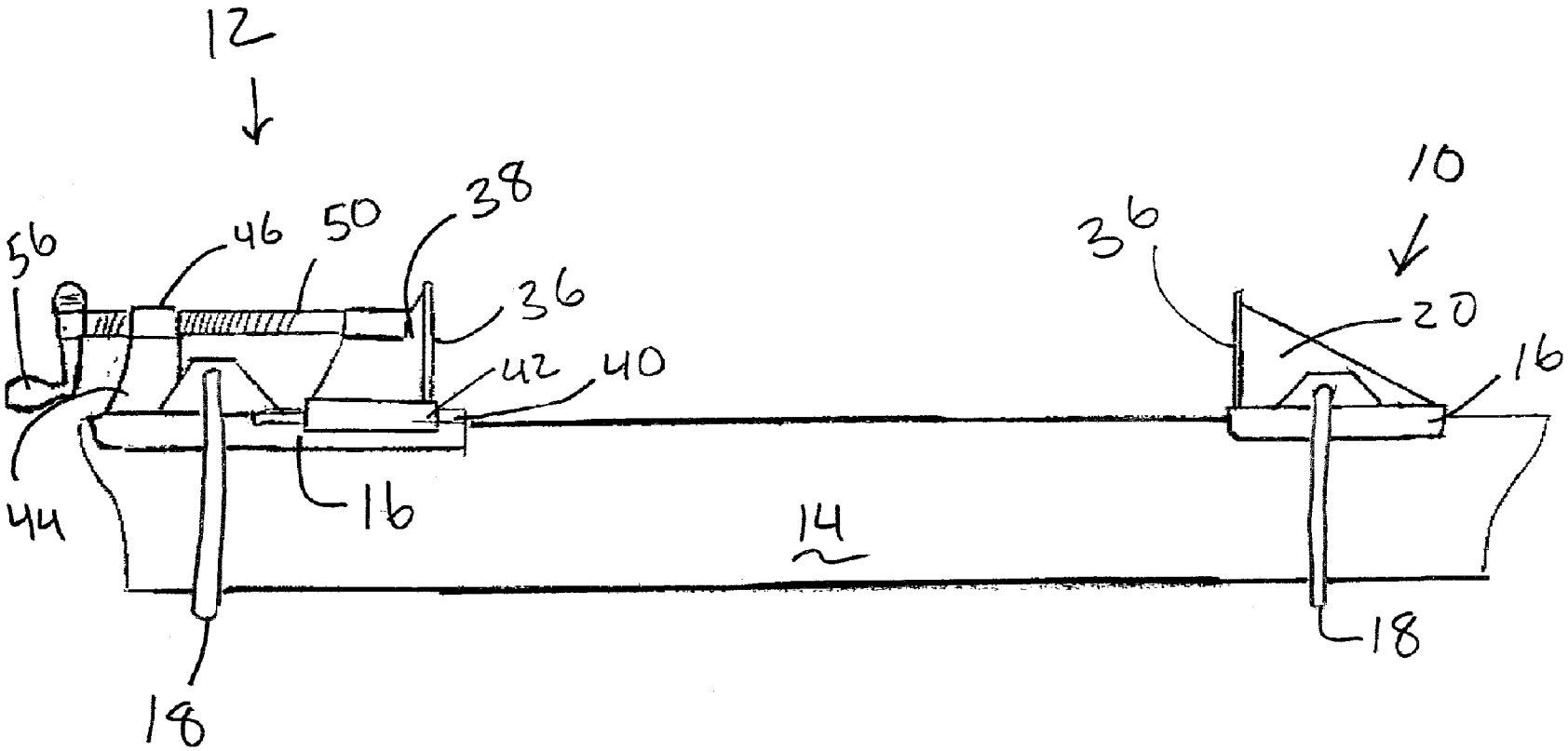
FIG. 5 is a side view of a clamping system according to the present invention.
Figure 6:
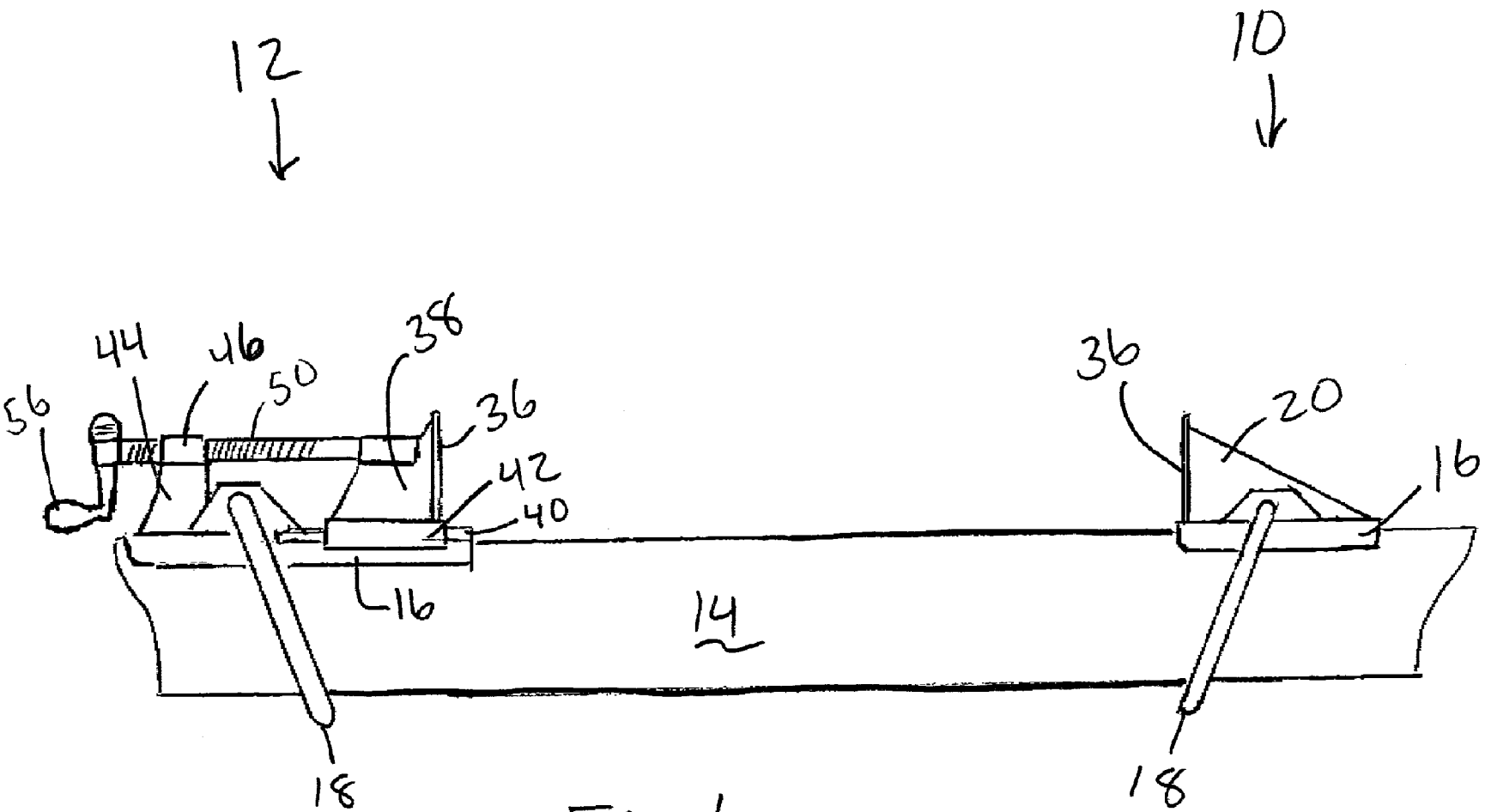
FIG. 6 is a side view of a clamping system according to the present invention.

The present invention is a clamping system, as shown in FIGS. 1–7. The clamping system is similar to the typical bar clamp, but allows clamping of very large objects such as a wall of a building. The clamping system includes fixed end 10 and an adjustable end 12. The fixed end 10 and the adjustable end 12 are both attached to lumber 14 instead of a metal bar, as shown in FIGS. 5–6. The advantages of using lumber 14 as a replacement for the metal bar in the clamping system of the present invention are the following. Lumber such as a two-by-four is easily found on a job site. The lumber 14 can be easier to handle than the length of metal required, as smaller pieces of lumber can be nailed together to make the required length of the bar.

Figure 1:
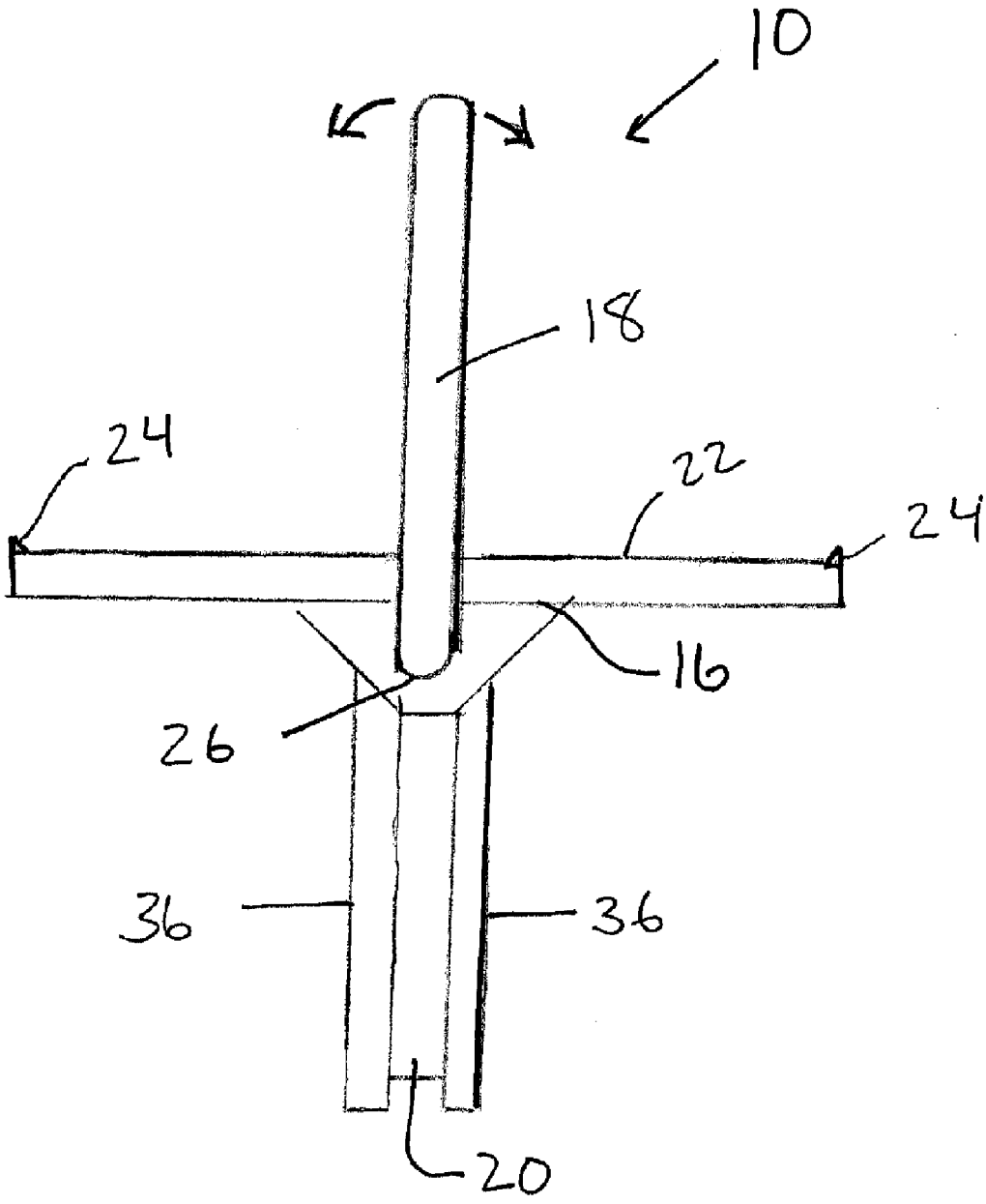
FIG. 1 is a side view of a fixed end according to the present invention.
Figure 2:
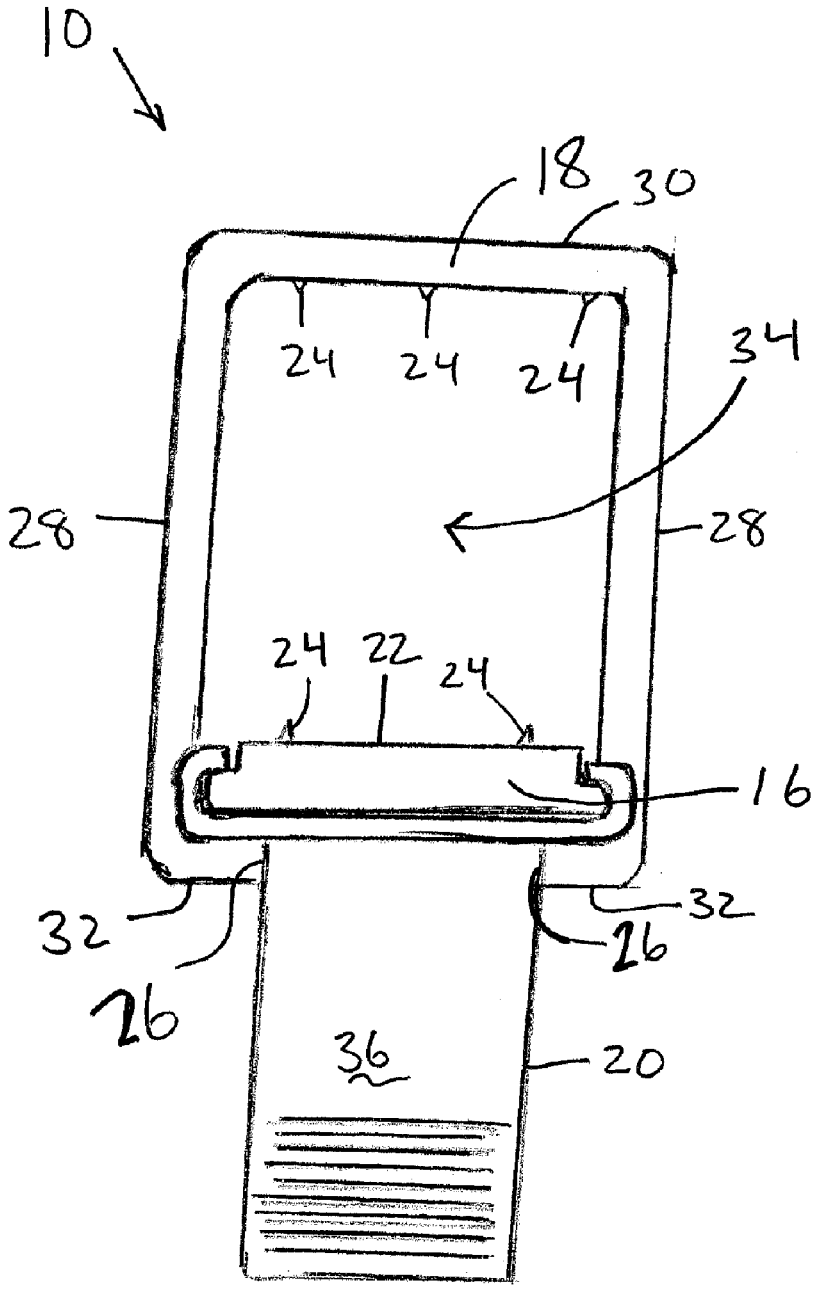
FIG. 2 is a front view of a fixed end according to the present invention.

FIGS. 1–2 show the fixed end 10 including a support 16, a lock ring 18 and a fixed face 20. The support 16 includes a flat surface 22 to contact the lumber 14. The flat surface 22 includes teeth 24 extending upward from the flat surface 22. The lock ring 18 is pivotally attached to support 16 at a point 26 below the flat surface 22, such that the lock ring 18 pivots above the flat surface 22 of the support 16. The lock ring 18 is shown as a rectangular shaped ring of material having two sides 28, a top 30 and a bottom 32. The lock ring 18 forms a receiving area 34 to receive the lumber 14. The receiving area 34 is within the boundaries of the two sides 28, top 30 and bottom 32 of the lock ring 18. The lock ring 18 includes teeth 24 extending into the receiving area 34 from the top 30 of the lock ring 18. The fixed face 20 extends downward from support 16 and provides two clamping surfaces 36.

FIGS. 3–4 show the adjustable end 12 including a support 16, a lock ring 18 and an adjustable face 38. The support 16 includes a flat surface 22 to contact the lumber 14. The flat surface 22 includes teeth 24 extending upward from the flat surface 22. The support 16 includes grooves 40 to receive the adjustable face 38, such that the adjustable face 38 can slide along the support 16. The lock ring 18 is pivotally attached to support 16 at a point 26 below the flat surface 22, such that the lock ring 18 pivots above the flat surface 22 of the support 16. The lock ring 18 is shown as a rectangular shaped ring of material having two sides 28, a top 30 and a bottom 32. The lock ring 18 forms a receiving area 34 to receive the lumber 14. The receiving area 34 is within the boundaries of the two sides 28, top 30 and bottom 32 of the lock ring 18. The lock ring 18 includes teeth 24 extending into the receiving area 34 from the top 30 of the lock ring 18. The adjustable face 38 includes two lips 42 which allow the adjustable face 38 to be slidably mounted to the support 16. The two lips 42 slide over the grooves 40 of the support 16. The adjustable face 38 includes a clamping surface 36. The support 16 also includes an adjustable rod extension 44 extending downward from the support 16 in a similar manner as the adjustable face 38. The adjustable rod extension 44 includes a round threaded receiver 46. Whereby, an inside surface 48 of the threaded receiver 46 is threaded to receive a turn screw 50, as shown in FIG. 4. The turn screw 50 has a first end 52 and second end 54. The first end 52 of the turn screw 50 is rotatably mounted to the adjustable face 38. The second end 54 of the turn screw 50 is threaded into the threaded receiver 46 and includes a handle 56 to rotate the turn screw 50.

Figure 7:
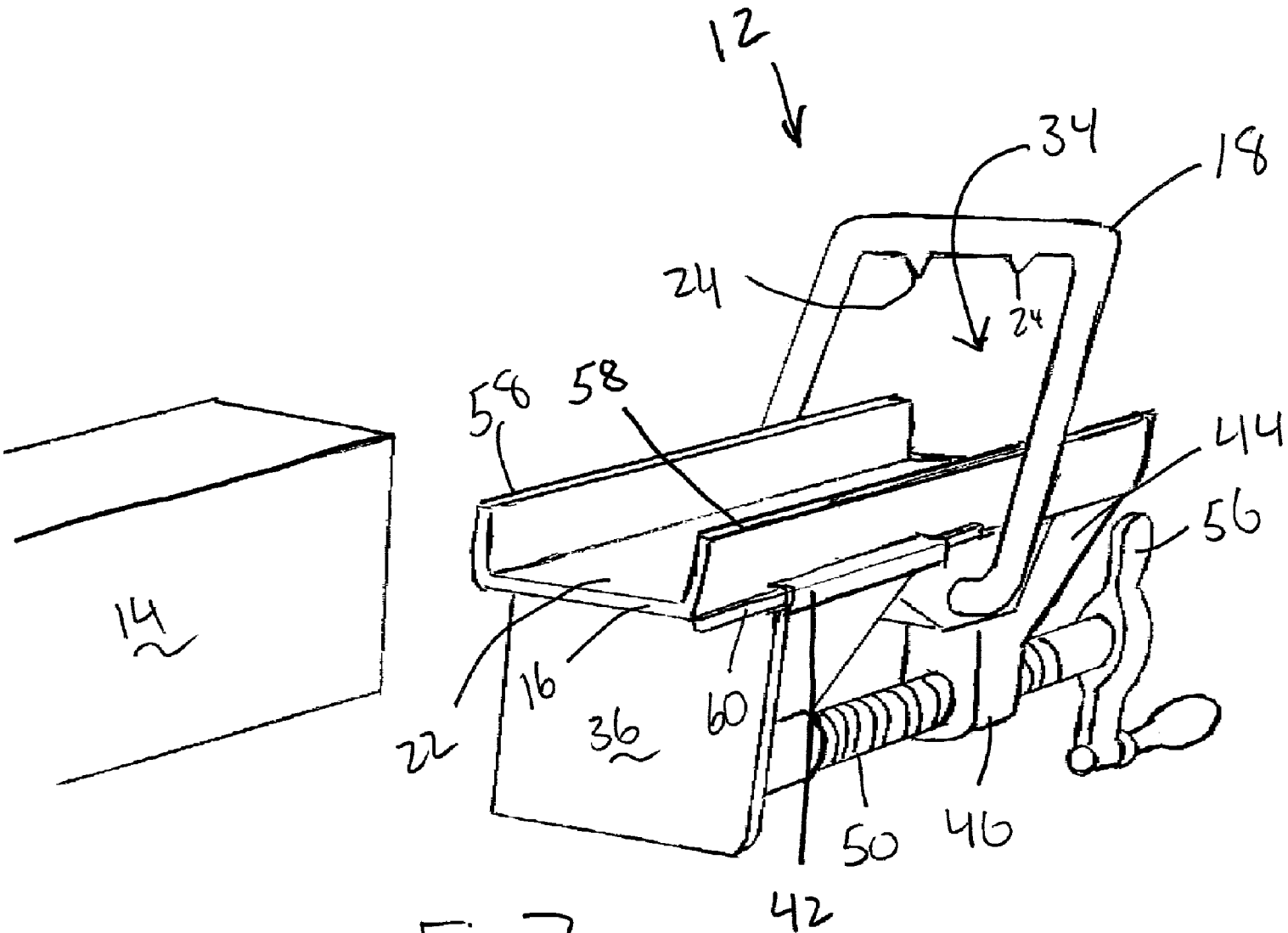
FIG. 7 is a perspective view of an adjustable end according to the present invention.

The clamping system of the present invention is used as follows and as shown in FIGS. 5–7. The lumber 14 is positioned above the flat surface 22 of the support 16 and into the lock ring 18 of the fixed end 10, as shown in FIG. 5. The size of the receiving area 34 of the lock ring 18 is determined by the type of lumber 14 to be used. For example, a good sized for the receiving area 34 within the lock ring 18 for a two-by-four is a rectangular opening of one-and-five-eighths inches by three-and-five-eighths inches, which is slightly larger than the two-by-four. A larger size lock ring 18 would be required for a larger size of lumber 14. The support 16 of the fixed end 10 is than pushed back along the lumber 14, while holding on to the lock ring 18. The end result of pushing the support 16 of the fixed end 10 along the lumber 14 is shown in FIG. 6. During movement of the support 16 of the fixed end 10, the top 30 of the lock ring 18 remains stationary and the bottom 32 of the lock ring 18 moves with the support 16. This causes the teeth 24 of the flat surface 22 and the lock ring 18 to dig into the lumber 14 and lock the fixed end 10 in place on the lumber 14. The flat surface 22 is now in contact with the lumber 14. The adjustable end 12 is mounted to the lumber 14 in the same manner as the fixed end 10 and positioned a proper distance away from the fixed end 10, which depends on the size of the object to be clamped. The adjustable end 12 and the fixed end 10 are positioned on the lumber 14 such that the clamping surfaces 36 of each are facing each other. The object is placed between the clamping surfaces 36 and readied to be clamped. The handle 56 is used to rotate the turn screw 50. Turning of the turn screw 50 one way pushes the adjustable face 38 along the support 16 of the adjustable end 12 towards the fixed end 10 and turning of the turn screw 50 the other way pulls the adjustable face 38 along the support 16 of the adjustable end 12 away from the fixed end 10. So, turning the turn screw 50 in the correct direction forces the clamping surface 36 of the adjustable face 38 against the object to be clamped and traps the object between the clamping surfaces 36 of the adjustable end 12 and the fixed end 10. FIG. 7 show a slightly different version of adjustable end 12. The support 16 includes sides 58 extending upward from the flat surface 22, which can also be applied to the fixed end 10. The grooves 40 are replaced by a rail 60 to which the lips 42 of the adjustable face 38 mount and slide along. FIGS. 5–7 show the fixed end 10 with only one clamping surface 36. The fixed end 10 and adjustable end 12 could also be positioned such that the clamping surfaces 36 of the fixed end 10 and adjustable end 12 face away from each other and allow a pushing motion.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

What is claimed is:

1. A clamping system, adapted to be used with lumber, comprising:

a fixed end, said fixed end including a support, said support including a contact surface adapted to contact the lumber, said fixed end including a lock ring pivotally attached to said support, said lock ring having a bottom, top and two sides which together form a receiving area above said contact surface to receive the lumber, said bottom being closest to said support, said receiving area above said contact surface, said fixed end including a fixed face with a clamping surface extending from said support; and an adjustable end, said adjustable end including a support, said support including a contact surface adapted to contact the lumber, said adjustable end including a lock ring pivotally attached to said support, said lock ring having a bottom, top and two sides which together form a receiving area above said contact surface to receive the lumber, said bottom being closest to said support, said receiving area above said contact surface, said adjustable end including an adjustable face with a clamping surface slidably mounted to said support, said adjustable face moveable along said support towards said fixed end to allow clamping between said clamping surface of said fixed end and said clamping surface of said adjustable end.

2. The clamping system of claim 1, wherein said lock ring of both said fixed and said adjustable end each include teeth extending into said receiving area from said top of said lock ring.

3. The clamping system of claim 1, wherein said contact surface of both said fixed and said adjustable end each include teeth extending upward to engage the lumber.

4. The clamping system of claim 1, wherein said adjustable end includes a turn screw connected between said adjustable face and said support to move said adjustable face along said support due to movement of said turn screw.

5. The clamping system of claim 4, wherein said support includes an adjustable rod extension extending downward from said support, said adjustable rod extension including a threaded receiver, an inside surface of said threaded receiver threaded to receive said turn screw, said turn screw having a first and second end, said first end of said turn screw rotatably mounted to said adjustable face, said second end of said turn screw threaded into said threaded receiver.

6. The clamping system of claim 5, wherein said lock ring of both said fixed and said adjustable end each include teeth extending into said receiving area from said top of said lock ring.

7. The clamping system of claim 6, further including a handle attached to said turn screw for turning said turn screw.

8. The clamping system of claim 5, wherein said contact surface of both said fixed and said adjustable end each include teeth extending upward to engage the lumber.

9. The clamping system of claim 8, further including a handle attached to said turn screw for turning said turn screw.

10. The clamping system of claim 4, further including a handle attached to said turn screw for turning said turn screw.

11. The clamping system of claim 5, further including a handle attached to said turn screw for turning said turn screw.

12. The clamping system of claim 5, wherein said support includes rails and said adjustable face includes lips which interact to allow said adjustable face to slide along said support.

13. The clamping system of claim 4, wherein said lock ring of both said fixed and said adjustable end each include teeth extending into said receiving area from said top of said lock ring.

14. The clamping system of claim 13, further including a handle attached to said turn screw for turning said turn screw.

15. The clamping system of claim 4, wherein said contact surface of both said fixed and said adjustable end each include teeth extending upward to engage the lumber.

16. The clamping system of claim 15, further including a handle attached to said turn screw for turning said turn screw.

17. The clamping system of claim 4, wherein said support includes grooves and said adjustable face includes lips which interact to allow said adjustable face to slide along said support.

18. The clamping system of claim 1, wherein said support includes grooves and said adjustable face includes lips which interact to allow said adjustable face to slide along said support.

19. The clamping system of claim 1, wherein said support includes rails and said adjustable face includes lips which interact to allow said adjustable face to slide along said support.

* * * * *